United States Patent [19]

Huggins

[11] 4,299,901

[45] Nov. 10, 1981

[54] METHOD OF DEVELOPMENT

[75] Inventor: Raymond W. Huggins, Pittsford, N.Y.

[73] Assignee: Xerox Corporation, Stamford, Conn.

[21] Appl. No.: 141,867

[22] Filed: Apr. 21, 1980

Related U.S. Application Data

[62] Division of Ser. No. 34,095, Apr. 27, 1979.

[51] Int. Cl.[3] ..... B05D 1/04

[52] U.S. Cl. ..... 430/122; 427/33; 427/47; 427/145; 427/197

[58] Field of Search ..... 427/18, 33, 47, 145, 427/197; 430/122

[56] References Cited

U.S. PATENT DOCUMENTS

| | | | |
|---|---|---|---|
| 3,543,720 | 12/1970 | Drexler et al. | 118/652 |
| 3,643,629 | 2/1972 | Kangas et al. | 118/658 |
| 3,703,395 | 11/1972 | Drexler et al. | 427/47 |
| 3,739,749 | 6/1973 | Kangas et al. | 118/658 |
| 3,900,001 | 8/1975 | Fraser et al. | 118/658 |
| 3,906,121 | 9/1975 | Fraser et al. | 430/122 |
| 4,076,857 | 2/1978 | Kasper et al. | 430/103 |

*Primary Examiner*—Bernard D. Pianalto
*Attorney, Agent, or Firm*—H. Fleischer; H. M. Brownrout

[57] ABSTRACT

An apparatus which develops a latent image by advancing a conductive developer composition comprising marking particles into contact therewith. The apparatus interacts with the developer composition causing the developer composition to have higher and lower regions of conductivity. In the regions of higher conductivity, development of the solid areas within the latent image is optimized. Development of lines within the latent image is optimized in the regions of lower conductivity.

34 Claims, 8 Drawing Figures

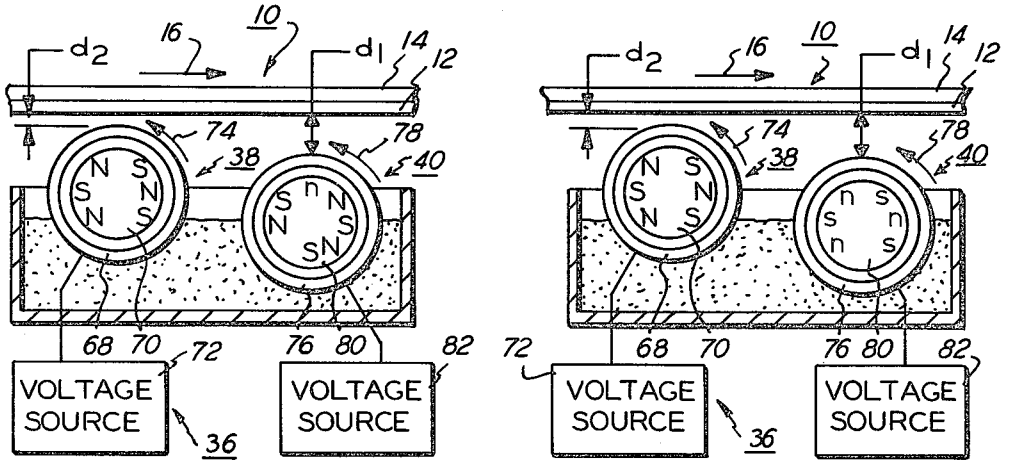
FIG. 4
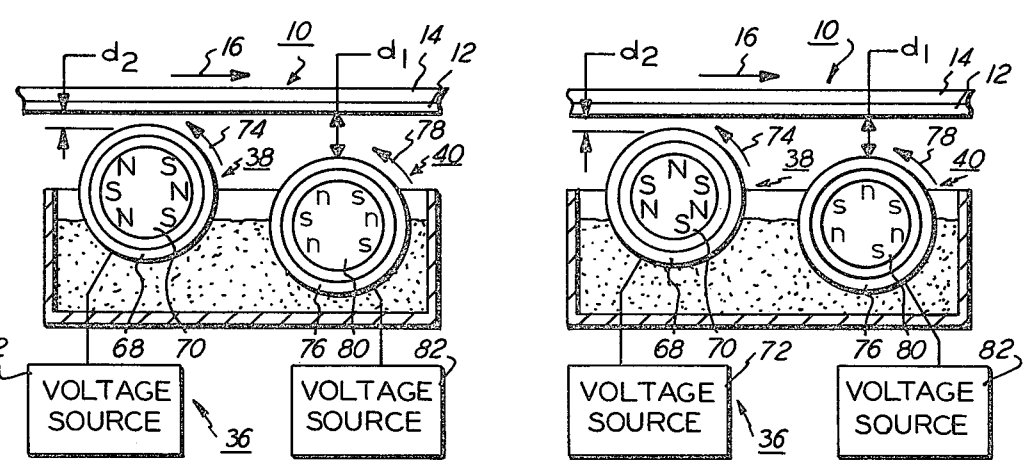
FIG. 5
FIG. 6

METHOD OF DEVELOPMENT

This is a division of application Ser. No. 034,095, filed, Apr. 27, 1979.

This invention relates generally to electrophotographic printing, and more particularly concerns an apparatus for developing a latent image.

Generally, an electrophotographic printing machine includes a photoconductive member which is charged to a substantially uniform potential to sensitize its surface. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer mix into contact therewith. This forms a powder image on the photoconductive member which is subsequently transferred to a copy sheet. Finally, the copy sheet is heated to permanently affix the powder image thereto in image configuration.

Frequently, the developer mix comprises toner particles adhering triboelectrically to carrier granules. This two component mixture is brought into contact with the latent image. The toner particles are attracted from the carrier granules to the latent image forming a powder image thereof. Hereinbefore, it has been difficult to develop both the large solid areas of the latent image and the lines thereof. Different techniques have been utilized to improve solid area development. Generally, a development electrode or a screening technique is employed to improve solid area development. These techniques are frequently used in conjunction with multi-roller magnetic brush development systems. However, systems of this type are rather complex and have suffered from poor development latitude or low density.

Various approaches have been devised to improve development. The following disclosure appears to be relevant:

- U.S. Pat. No. 3,543,720; Patentee: Drexler et al.; Issued: Dec. 1, 1970.
- U.S. Pat. No. 3,643,629; Patentee: Kangas et al.; Issued: Feb. 22, 1972.
- U.S. Pat. No. 3,703,395; Patentee: Drexler et al.; Issued: Nov. 21, 1972.
- U.S. Pat. No. 3,739,749; Patentee: Kangas et al.; Issued: June 19, 1973.
- U.S. Pat. No. 3,900,001; Patentee: Fraser et al.; Issued: Aug. 19, 1975.
- U.S. Pat. No. 3,906,121; Patentee: Fraser et al.; Issued: Sept. 16, 1975.
- U.S. Pat. No. 4,076,857; Patentee: Kasper et al.; Issued: Feb. 28, 1978.
- Research Disclosure Journal; April, 1978; Page 4, No. 16823; Disclosed by: Paxton.

The pertinent portions of the foregoing disclosures may be briefly summarized as follows:

The Drexler et al. patents disclose two magnetic brushes arranged so that the feed brush feeds developer material to the discharge brush. The feed brush is spaced further from the insulating surface having the electrostatic charge pattern thereon than the discharge brush. In FIG. 3 of Drexler et al. (U.S. Pat. No. 3,703,395), the feed portion of the brush contains stronger magnets than the discharge portion.

The Kangas et al. patents describe an applicating roller and a scavenging roller. The applicating roller has a plurality of magnets arranged to provide a magnetic field around the roller having a feed zone with a radial field changing to a tangential field, an applicating zone with a stronger radial field following the feed zone and a return zone extending from the applicating zone to the feed zone and having a stronger tangential field immediately following the applicating zone.

The Fraser et al. patents disclose a magnetic brush in which the region opposed from the photoconductive surface, in the development zone, has no magnetic poles. In this way, the development zone is substantially free of the influence of the magnetic field used to maintain the developer material in a brush configuration.

Kasper et al. teaches that development of large solid area images at high processing rates may be accomplished by establishing an electrical field greater than the electrical breakdown value of the developer material.

Paxton describes a magnetic brush in which the conductivity of the developer material in the nip between the brush and photoconductor is adjusted by varying the amount or density of the developer material in the nip. To provide improved copy contrast, and fringiness between solid area and line development, the amount of developer in the nip and/or the electrical bias applied to the magnetic brush is selectively adjusted.

In accordance with the present invention, there is provided an apparatus for developing a latent image. The apparatus includes first means for advancing a conductive developer composition comprising marking particles into contact with the latent image. The first means interacts with the developer composition causing the developer composition to have a first conductivity optimized to develop solid areas of the latent image with the marking particles. Second means, spaced from the first means, advances the developer composition into contact with the latent image. The second means interacts with the developer composition causing the developer composition to have a second conductivity less than the first conductivity. The second conductivity is optimized to develop lines of the latent image with marking particles.

Other aspects of the present invention will become apparent as the following description proceeds and upon reference to the drawings, in which:

BRIEF DESCRIPTION OF THE DRAWINGS

FIG. 4 is a schematic elevational view showing another embodiment of the development system used in the FIG. 1 printing machine;

FIG. 5 is a schematic elevational view depicting another embodiment of the development system used in the FIG. 1 printing machine;

FIG. 6 is a schematic elevational view illustrating another embodiment of the development system used in the FIG. 1 printing machine;

For a general understanding of the features of the present invention, reference is had to the drawings. In the drawings, like reference numerals have been used to designate identical elements. FIG. 1 schematically depicts the various components of an illustrative electrophotographic printing machine incorporating the development apparatus of the present invention therein. It will become apparent from the following discussion that this development apparatus is equally well suited for use in a wide variety of electrostatographic printing machines and is not necessarily limited in its application to the particular embodiment shown therein.

DESCRIPTION OF THE PREFERRED EMBODIMENT

Inasmuch as the art of electrophotographic printing is well known, the various processing stations employed in the FIG. 1 printing machine will be shown hereinafter schematically and their operation described briefly with reference thereto.

Figure 1:
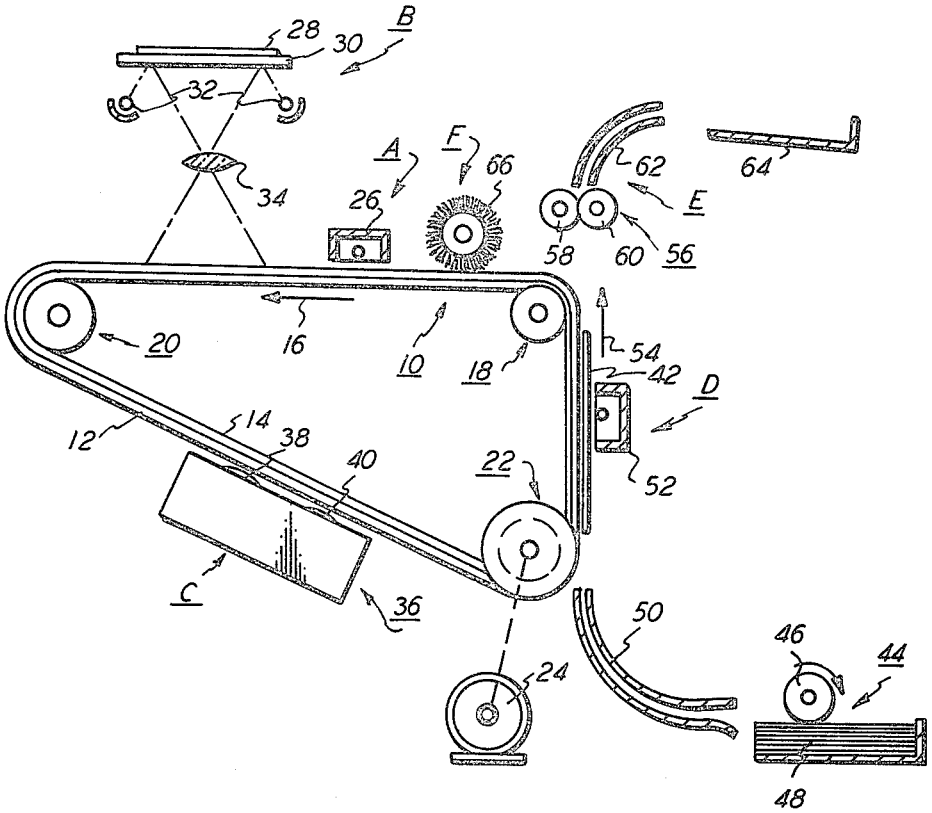
FIG. 1 is a schematic elevational view depicting an electrophotographic printing machine incorporating the features of the present invention therein.

As shown in FIG. 1, the electrophotographic printing machine employs a belt 10 having a photoconductive surface 12 deposited on a conductive substrate 14. Preferably, photoconductive surface 12 comprises a transport layer containing small molecules of m-TBD dispersed in a polycarbonate and a generation layer of trigonal selenium. Conductive substrate 14 is made preferably from aluminized Mylar. Conductive substrate 14 is electrically grounded. Belt 10 moves in the direction of arrow 16 to advance successive portions of photoconductive surface 12 sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive. Drive roller 22 includes a pair of opposed spaced edge guides. The edge guides define a space herebetween which determines the desired path of movement for belt 10. Belt 10 is maintained in tension by a pair of springs (not shown) resiliently urging tension roller 22 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image on the charged portion of photoconductive surface 12 to selectively dissipate the charge thereon. This records an electrostatic latent image on photoconductive surface 12 which corresponds to the informational areas contained within original document 28.

Thereafter, belt 10 advances the electrostatic latent image recorded on photoconductive surface 12 to development station C. At development station C, a magnetic brush development system, indicated generally by the reference numeral 36, advances a conductive developer composition into contact with the electrostatic latent image. Preferably, magnetic brush development system 36 includes two magnetic brush rollers 38 and 40. These rollers each advance the developer composition into contact with the latent image. Each developer roller forms a brush comprising carrier granules and toner particles. The latent image attracts the toner particles from the carrier granules forming a toner powder image on photoconductive surface 12 of belt 10. The detailed structure of magnetic brush development system 36 will be described hereinafter with reference to FIGS. 2 through 6, inclusive.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, sheet feeding apparatus 44 includes a feed roll 46 contacting the upper sheet of stack 48. Feed roll 46 rotates so as to advance the uppermost sheet from stack 48 into chute 50. Chute 50 directs the advancing sheet of support material into contact with photoconductive surface 12 of belt 10 in a timed sequence so that toner powder image developed thereon contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, fuser assembly 56 includes a heated fuser roller 58 and a back-up roller 60. Sheet 42 passes between fuser roller 58 and back-up roller 60 with the toner powder image contacting fuser roller 58. In this manner, the toner powder image is permanently affixed to sheet 42. After fusing, chute 62 guides the advancing sheet 42 to catch tray 64 for removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a rotatably mounted fiberous brush 66 in contact with photoconductive surface 12. The particles are cleaned from photoconductive surface 12 by the rotation of brush 66 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine.

Referring now to the specific subject matter of the present invention, solid areas of the electrostatic latent image are optimumly developed by a highly conductive developer composition. However, lines within the electrostatic latent image are optimumly developed with a developer composition of lower conductivity. Under controlled conditions, the conductivity of the developer composition may be varied to achieve both of the foregoing objectives.

Figure 2:
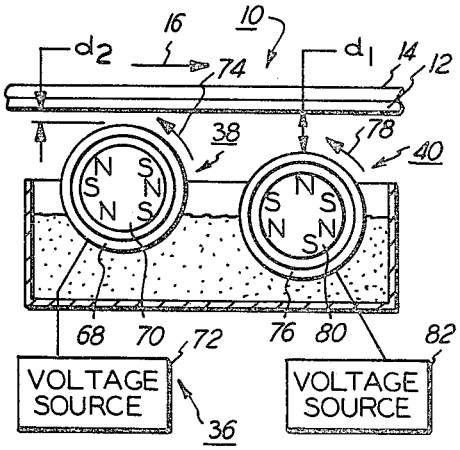
FIG. 2 is a schematic elevational view showing one embodiment of the development system employed in the FIG. 1 printing machine.

FIG. 2 depicts one embodiment of magnetic brush development system 36 designed to achieve the foregoing. As depicted thereat, developer roller 38 includes a non-magnetic tubular member 68 journaled for rotation. Preferably, tubular member 68 is made from aluminum having the exterior surface thereof roughened. An elongated magnetic rod 70 is positioned concentrically within tubular member 68 being spaced from the interior surface thereof. Magnetic rod 70 has a plurality of poles impressed thereon. No magnetic poles are positioned in the development zone, i.e. in the nip opposed from belt 10. The magnetic field in the development zone is in a tangential direction. By way of example, magnetic rod 70 is made from barium ferrite.

Tubular member 68 is electrically biased by voltage source 72. Voltage source 72 supplies a potential having a suitable polarity and magnitude to tubular member 68 to form an electrical field. A motor (not shown) rotates tubular member 68 at a constant angular velocity. A brush of developer mixture is formed on the peripheral surface of tubular member 68. As tubular member 68 rotates in the direction of arrow 74, the brush of developer composition advances into contact with the latent image. The toner particles are attracted from the carrier granules to the latent image forming a toner powder image on photoconductive surface 12.

Voltage source 72 is arranged to electrically bias tubular member 68. Since the developer composition is conductive and contacting belt 10 which is grounded, an electrical field is formed. The electrical field vector is substantially perpendicular to the magnetic field vector. When the electrical field vector is perpendicular to the magnetic field vector, the conductivity of the developer composition is maximized. In addition, tubular member 68 is spaced a distance $d_2$ from photoconductive surface 12. The spacing between the photoconductive surface and the tubular member is also designed to maximize the conductivity of the developer composition. Thus, both of these independent variables define the conductivity of the developer composition, i.e. the spacing between the tubular member and photoconductive surface, and the orientation of the magnetic field vector with respect to the electrical field vector.

Developer compositions that are particularly useful are those that comprise magnetic carrier granules having toner particles adhering thereto triboelectrically. More particularly, the carrier granules have a ferromagnetic core having a thin layer of magnetite overcoated with a non-continuous layer of resinous material. Suitable resins include poly (vinylidene fluoride) and poly (vinylidene fluoride-co-tetrafluorethylene). The developer composition can be prepared by mixing the carrier granules with toner particles. Generally, any of the toner particles known in the art are suitable for mixing with the carrier granules. Suitable toner particles are prepared by finely grinding a resinous material and mixing it with a coloring material. By way of example, the resinous material may be a vinyl polymer such as polyvinyl chloride, polyvinylidene chloride, polyvinyl acetate, polyvinyl acetals, polyvinyl ether and polyacrylic. Suitable coloring materials may be amongst others, chromogen black, and solvent black. The developer comprises from about 95 to about 99% by weight of carrier and from about 5 to about 1% by weight of toner. These and other materials are disclosed in U.S. Pat. No. 4,076,857 issued to Kasper et al. in 1978, the relevant portions thereof being hereby incorporated into the present application.

Magnetic brush developer roller 40 includes a non-magnetic tubular member 76 journaled for rotation in the direction of arrow 78. A magnetic rod 80 is disposed concentrically within tubular member 76 being spaced from the interior surface thereof. By way of example, tubular member 76 is preferably made from aluminum having a roughened exterior surface thereon. Magnetic rod 80 has a plurality of magnetic poles impressed thereon. However, one magnetic pole is positioned in the development zone, i.e. the region opposed from belt 10. As shown, a north pole is disposed opposite belt 10 in the development zone nip. The magnetic field, in the development zone, is in a radial direction.

Voltage source 82 electrically biases tubular member 76 to a suitable potential and magnitude. A motor (not shown) rotates tubular member 76 at a constant angular velocity to advance the developer mixture into contact with the latent image. The resultant electrical field vector is parallel to the magnetic field vector. When the electrical field vector is parallel to the magnetic field vector, the conductivity of the developer composition is less than when the electrical field vector is perpendicular to the magnetic field vector.

Tubular member 76 is spaced from photoconductive surface 12 a distance $d_1$. Spacing $d_1$ of tubular member 76 from photoconductive surface 12 is greater than spacing $d_2$ of tubular member 68 from photoconductive surface 12. Inasmuch as in the region opposed from photoconductive surface 12 the magnetic field vector is parallel to the electrical field vector and the spacing between tubular member 76 and photoconductive surface 12 is relatively large, the conductivity of the developer composition, in this region, is significantly less than the conductivity of the developer composition being employed by magnetic brush roller 38. The lower conductivity of the developer composition used by magnetic brush roller 40 optimizes development of the lines within the electrostatic latent image. Contrariwise, the higher conductivity of the developer composition employed by magnetic brush developer roller 38 optimizes development of the solid areas in the electrostatic latent image.

It is apparent that magnetic brush developer roller 38 is designed to optimize development of solid areas in the electrostatic latent image while magnetic brush developer roller 40 optimizes development of the lines therein.

Figure 3:
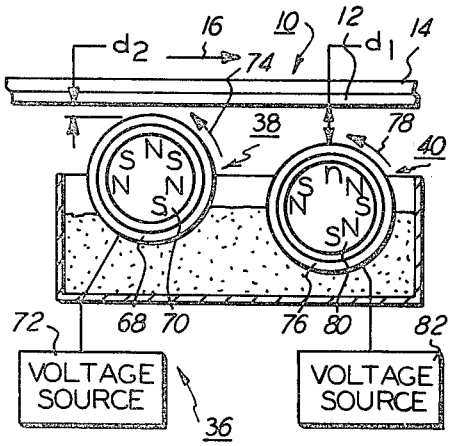
FIG. 3 is a schematic elevational view illustrating another embodiment of the development system used in the FIG. 1 printing machine.

Referring now to FIG. 3, there is shown another embodiment of magnetic brush development system 36. The configuration of roller 38 is identical to that of roller 40 shown in FIG. 2. Magnetic brush development roller 38 includes tubular member 68 having magnetic rod 70 disposed concentrically therein and being spaced from the interior surface thereof. Magnetic rod 70 is oriented so that a pole is opposed from belt 10 in the nip of the development zone. The magnetic field, in the development zone is in the radial direction. Once again, a motor (not shown) rotates tubular member 68 in the direction of arrow 74. Tubular member 68 is spaced from photoconductive surface 12 a distance $d_2$. Inasmuch as a north pole is disposed opposite photoconductive surface 12, in the nip of the development zone, and tubular member 68 is positioned closely adjacent to photoconductive surface 12, the developer composition has a relatively high conductivity. However, the resultant conductivity is less than that of roller 38 shown in FIG. 2. Voltage source 72 is arranged to electrically bia tubular member 68 to a suitable magnitude and polarity. The resultant electrical field vector is substantially parallel to the magnetic field vector.

Turning now to development roller 40, tubular member 76 is journaled for rotation and has a magnetic rod 80 disposed concentrically therein. Magnetic rod 80 has a plurality of magnetic poles impressed about the peripheral surface thereof. A weak magnet pole is positioned opposed from belt 10 in the nip of the development zone. Moreover, tubular member 76 is spaced a distance $d_1$ from photoconductive surface 12. The spacing between the photoconductive surface and tubular member 76 is maximized. Thus, the relatively large spacing in conjunction with the positioning of a weak magnetic pole opposed from the photoconductive belt, interacts with the developer conductivity to produce a conductivity lower than that in the region of roller 38. Hence, magnetic brush roller 40 is arranged to optimize development of lines with roller 38 being arranged to develop solid areas.

Turning now to FIG. 4, there is shown another embodiment of magnetic brush development system 36. The configuration of roller 38 is identical to that of roller 38 shown in FIG. 2. Magnetic rod 70 is oriented so that no magnetic pole is positioned in the development zone. The magnetic field, in the development zone, is in a tangential direction. The resultant magnetic field vector is normal to the electrical field vector maximizing the conductivity of the developer composition. Developer roller 40 is of a configuration identical to that of developer roll 40 shown in FIG. 3. Magnetic rod 80 is oriented so that a weak magnetic pole is positioned opposite belt 10 in the nip of the development zone. The spacing $d_1$ of tubular member 76 from photoconductive surface 12 is greater than the spacing $d_2$ of tubular member 68 from photoconductive surface 12. Hence, the conductivity of the developer composition in the region of roller 38 is greater than the conductivity of the developer composition in the region of roller 40.

Referring now to FIG. 5, there is shown still another embodiment of magnetic brush development system 36. As shown therein, the configuration of roller 38 is identical to that of roller 38 shown in FIG. 2. The configuration of roller 40 is identical to that of roller 38. However, the magnetic poles impressed on magnetic rod 80 and roller 40 are relatively weaker than those impressed on magnetic rod 70 of roller 38. Thus, the magnetic field eminating from roller 40 is weaker than that generated by roller 38. In addition, the spacing $d_1$ of roller 40 from photoconductive surface 12 is greater than the spacing $d_2$ of roller 38 from photoconductive surface 12. This results in the developer composition, in the region of roller 38, having a higher conductivity than the developer composition in the region of roller 40.

Turning now to FIG. 6, there is shown yet another embodiment of magnetic brush development system 36. As depicted therein, roller 38 is identical to roller 38 of FIG. 3. The configuration of roller 40 is identical to that of roller 38. However, the magnetic poles impressed on magnetic rod 80 are relatively weaker than those impressed on magnetic rod 70. Hence, the magnetic field eminating from roller 40 is weaker than that generated by roller 38. Furthermore, the spacing $d_1$ of roller 40 from photoconductive surface 12 is greater than the spacing $d_2$ of roller 38 from photoconductive surface 12. This results in the developer composition, in the region of roller 38, having a higher conductivity than the developer composition in the region of roller 40.

Figure 7:
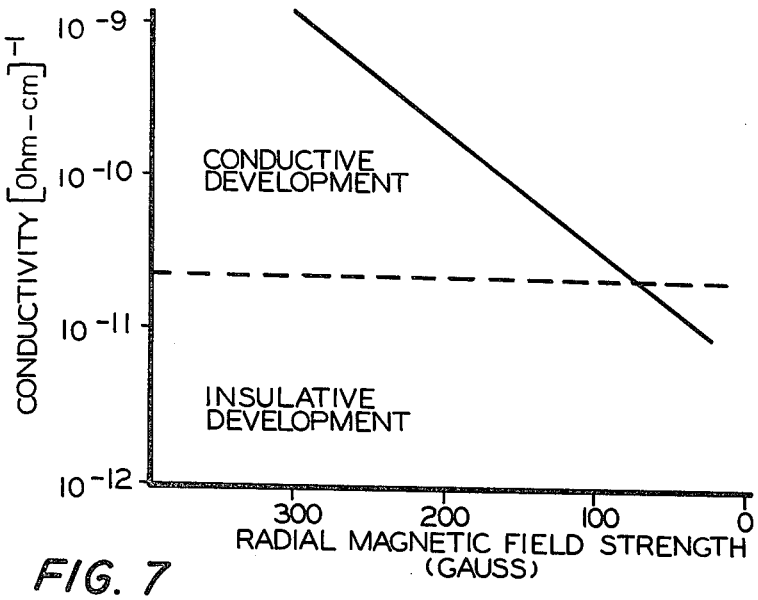
FIG. 7 is a graph illustrating the relationship between developer conductivity and magnetic field strength.

Referring now to FIG. 7, there is shown a graph of the developer composition conductivity as a function of the radial magnetic field strength. It is seen that the conductivity varies from about $10^{-9}$ to less than $10^{-11}$ (ohm-centimeters)$^{-1}$ as the magnetic field strength varies from about 300 to about 50 gauss. The radial magnetic field strength is changed by rotating the poles of the magnet relative to the nip of the development zone or the electrical field. Hence, the radial magnetic field is maximized when a magnetic pole is opposed from the photoconductive surface in the nip of the development zone. The field is reduced as the pole moves away from the nip of the development zone. Alternatively, a weak magnetic pole may be positioned opposed from the photoconductive surface in the nip of the development zone. It is thus seen that the conductivity of the developer composition decreases as the magnetic field strength decreases. A highly conductive developer composition optimize development of solid areas in the electrostatic latent image. However, lines in the electrostatic latent image are optimumly developed by a developer composition having a lower conductivity. Thus, it is seen that it is highly desirable to be capable of having two different types of developers i.e., a highly conductive composition for developing solid areas and a relatively lower conductive composition for developing lines.

Figure 8:
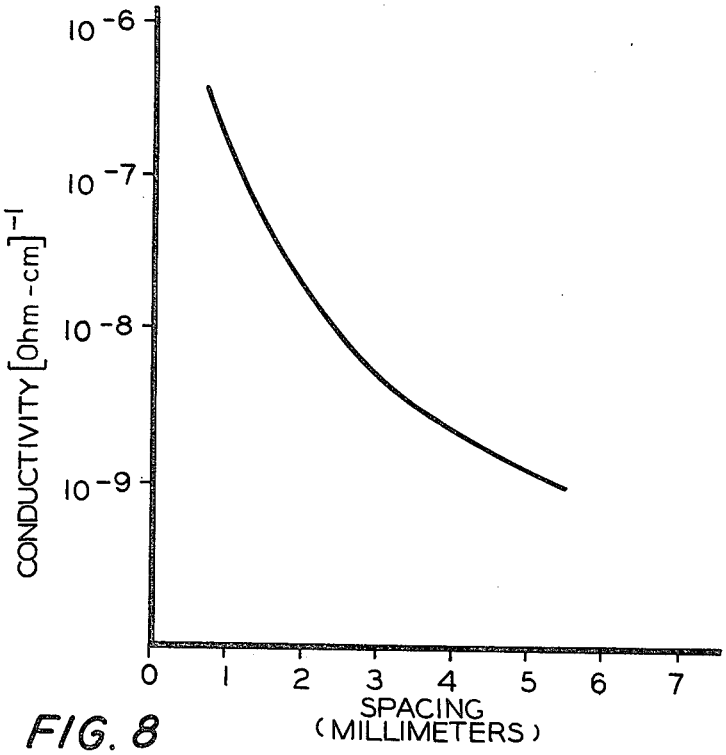
FIG. 8 is a graph depicting the relationship between developer conductivity and the spacing between the developer roller and the photoconductive surface.

Referring now to FIG. 8, the variation of conductivity as a function of the spacing of the developer roll from the photoconductive surface is shown thereat. Conductivity decreases as the spacing increases. Hence, the conductivity of the developer composition varies inversely with the spacing. As the spacing between the tubular member and photoconductive surface is increased, the conductivity of the developer composition decreases. It is seen that the developer composition conductivity varies from about $10^{-7}$ (ohm-centimeters)$^{-1}$ at 1 millimeter spacing to about $10^{-9}$ (ohm-centimeter)$^{-1}$ at about 6 millimeters. It is evident that there are two independent variables which affect conductivity of the developer composition, i.e. the strength of the radial magnetic field and the spacing of the tubular member from the photoconductive surface. These parameters may be varied independently. Ideally, they should be utilized to reinforce one another so as to optimize development.

In recapitulation, it is evident that the development apparatus of the present invention optimizes solid area and line development by using two developer rollers. One of the developer rollers has a stronger magnetic field and is positioned closely adjacent to the photoconductive surface. The conductivity of the developer composition for this developer roller is relatively high to optimize development of the solid areas of the electrostatic latent image. Contrariwise, the other developer roller has a weaker magnetic field and is spaced a relatively greater distance from the photoconductive surface. In this manner, the conductivity of the developer composition is maintained significantly lower. Hence, this latter developer roller optimizes development of the lines within the electrostatic latent image.

It is, therefore, evident that there has been provided in accordance with the present invention an apparatus for developing an electrostatic latent image that optimizes development of both the solid areas and lines contained therein. This apparatus fully satisfies the aims and advantages hereinbefore set forth. While this invention has been described in conjunction with specific embodiments and methods of use, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A method of developing a latent image with a conductive developer composition comprising marking particles, including the steps of:

contacting the latent image with the developer composition in at least a first region and a second region, with the first region being spaced from the second region, to deposit marking particles onto the latent image, thereby developing the latent image; and controlling the development process to cause the developer composition to have a first conductivity in the first region to optimize development of the solid areas within the latent image with the marking particles, and to cause the developer composition to have a second conductivity in the second region with the second conductivity being lower than the first conductivity to optimize development of the lines within the latent image with the marking particles.

2. A method as recited in claim 1, wherein said step of controlling includes the steps of:

forming a magnetic field in the first region; and generating an electrical field in the first region with the magnetic field vector being substantially parallel to the electrical field vector.

3. A method as recited in claim 2, wherein said step of forming includes the step of orienting a magnetic member so as to position a magnetic pole opposed to the latent image in the first region.

4. A method as recited in claim 3, wherein said step of controlling includes the step of orienting a magnetic member so as to position a weak magnetic pole opposed to the latent image in the second region.

5. A method as recited in claim 4, wherein said step of controlling includes the step of positioning the magnetic member in the first region a first distance from the latent image and the magnetic member in the second region a second distance from the latent image with the first distance being less than the second distance.

6. A method as recited in claim 2, wherein said step of controlling includes the steps of:

orienting a magnetic member so as to position a magnetic pole opposed to the latent image in the second region; and generating a weaker magnetic field in the second region than in the first region.

7. A method as recited in claim 6, wherein said step of controlling includes the step of positioning the magnetic member in the first region a first distance from the latent image and the magnetic member in the second region a second distance from the latent image with the first distance being less than the second distance.

8. A method as recited in claim 1, wherein said step of contacting includes the steps of:

attracting the developer composition to a first member positioned in the first region and spaced a first distance from the latent image;

moving the first member to advance the developer composition into contact with the latent image in the first region;

attracting the developer composition to a second member positioned in the second region and spaced a second distance from the latent image with the first distance being less than the second distance; and moving the second member to advance the developer composition into contact with the latent image in the second region.

9. A method of developing a latent image with a conductive developer composition comprising marking particles, including the steps of:

contacting the latent image with the developer composition in at least a first region and a second region, with the first region being spaced from the second region, to deposit marking particles onto the latent image, thereby developing the latent image; and controlling the development process to cause the developer composition to have a first conductivity in the first region to optimize development of the solid areas within the latent image with the marking particles, and to cause the developer composition to have a second conductivity in the second region with the second conductivity being lower than the first conductivity to optimize development of the lines within the latent image with the marking particles, said step of controlling comprising the steps of forming a magnetic field in the first region, and generating an electrical field in the first region with the magnetic field vector being substantially normal to the electrical field vector.

10. A method as recited in claim 9, wherein said step of forming includes the step of orienting a magnetic member so as to position remotely the magnetic poles from the region opposed to the latent image in the first region.

11. A method as recited in claim 10, wherein said step of controlling includes the steps of:

forming a magnetic field in the second region; and generating an electrical field in the second region with the magnetic field vector being substantially parallel to the electrical field vector.

12. A method as recited in claim 11, wherein said step of forming includes the step of orienting a magnetic member so as to position a magnetic pole opposed to the latent image in the second region.

13. A method as recited in claim 12, wherein said step of controlling includes the step of positioning the magnetic member in the first region a first distance from the latent image and the magnetic member in the second region a second distance from the latent image with the first distance being less than the second distance.

14. A method as recited in claim 10, wherein said step of forming includes the step of orienting a magnetic member to position a weak magnetic pole opposed to the latent image in the second region.

15. A method as recited in claim 14, wherein said step of controlling includes the step of positioning the magnetic member in the first region a first distance from the latent image and the magnetic member in the second region a second distance from the latent image with the first distance being less than the second distance.

16. A method as recited in claim 10, wherein said step of controlling includes the steps of:

orienting a magnetic member so as to position remotely the magnetic poles from the region opposed to the latent image in the second region; and generating a weaker magnetic field in the second region than in the first region.

17. A method as recited in claim 16, wherein said step of controlling includes the step of positioning the magnetic member in the first region a first distance from the latent image and the magnetic member in the second region a second distance from the latent image with the first distance being less than the second distance.

18. A method of electrophotographing printing, including the steps of:

recording an electrostatic latent image on a photoconductive surface;

contacting the electrostatic latent image with a conductive developer composition comprising carrier granules having toner particles adhering thereto triboelectrically in at least a first region and a second region, with the first region being spaced from the second region, to deposit toner particles onto the electrostatic latent image, thereby developing the electrostatic latent image; and controlling the development process to cause the developer composition to have a first conductivity in the first region to optimize development of the solid areas within the electrostatic latent image with the toner particles, and to cause the developer composition to have a second conductivity in the second region with the second conductivity being lower than the first conductivity to optimize development of the lines within the latent image with the toner particles.

19. A method of printing as recited in claim 18, wherein said step of controlling includes the steps of:

forming a magnetic field in the first region; and generating an electrical field in the first region with the magnetic field vector being substantially parallel to the electrical field vector.

20. A method of printing as recited in claim 19, wherein said step of forming includes the step of orienting a magnetic member so as to position a magnetic pole opposed to the photoconductive surface in the first region.

21. A method of printing as recited in claim 20, wherein said step of controlling includes the step of orienting a magnetic member so as to position a weak magnetic pole opposed to the photoconductive surface in the second region.

22. A method of printing as recited in claim 21, wherein said step of controlling includes the step of positioning the magnetic member in the first region a first distance from the photoconductive surface and the magnetic member in the second region a second distance from the photoconductive surface with the first distance being less than the second distance.

23. A method of printing as recited in claim 19, wherein the step of controlling includes the steps of:

orienting a magnetic member so as to position a magnetic pole opposed to the photoconductive surface in the second region; and generating a weaker magnetic field in the second region than in the first region.

24. A method of printing as recited in claim 23, wherein said step of controlling includes the step of positioning the magnetic member in the first region a first distance from the photoconductive surface and the magnetic member in the second region a second distance from the photoconductive surface with the first distance being less than the second distance.

25. A method of printing as recited in claim 18, wherein said step of contacting includes the steps of:

attracting the developer composition to a first member positioned in the first region and spaced a first distance from the photoconductive surface;

moving the first member to advance the developer composition into contact with the electrostatic latent image in the first region;

attracting the developer composition to a second member positioned in the second region and spaced a second distance from the photoconductive surface with the first distance being less than the second distance; and moving the second member to advance the developer composition into contact with the electrostatic latent image in the second region.

26. A method of electrophotographing printing, including the steps of:

recording an electrostatic latent image on a photoconductive surface;

contacting the electrostatic latent image with a conductive developer composition comprising carrier granules having toner particles adhering thereto triboelectrically in at least a first region and a second region, with the first region being spaced from the second region, to deposit toner particles onto the electrostatic latent image, thereby developing the electrostatic latent image; and controlling the development process to cause the developer composition to have a first conductivity in the first region to optimize development of the solid areas within the electrostatic latent image with the toner particles, and to cause the developer composition to have a second conductivity in the second region with the second conductivity being lower than the first conductivity to optimize development of the lines within the latent image with the toner particles, said step of controlling comprising the steps of forming a magnetic field in the first region, and generating an electrical field in the first region with the magnetic field vector being substantially normal to the electrical field vector.

27. A method of printing as recited in claim 26, wherein said step of forming includes the step of orienting a magnetic member so as to position remotely the magnetic poles from the region opposed to the electrostatic latent image in the first region.

28. A method of printing as recited in claim 27, wherein said step of controlling includes the steps of:

forming a magnetic field in the second region; and generating an electrical field in the second region with the magnetic field vector being substantially parallel to the electrical field vector.

29. A method of printing as recited in claim 28, wherein said step of forming includes the step of orienting a magnetic member so as to position a magnetic pole opposed to the electrostatic latent image in the second region.

30. A method of printing as recited in claim 29, wherein said step of controlling includes the step of positioning the magnetic member in the first region a first distance from the photoconductive surface and the magnetic member in the second region a second distance from the photoconductive surface with the first distance being less than the second distance.

31. A method of printing as recited in claim 27, wherein said step of forming includes the step of orienting a magnetic member to position a weak magnetic pole opposed to the photoconductive surface in the second region.

32. A method of printing as recited in claim 31, wherein said step of controlling includes the step of positioning the magnetic member in the first region a first distance from the photoconductive surface and the magnetic member in the second region a second distance from the latent image with the first distance being less than the second distance.

33. A method of printing as recited in claim 27, wherein said step of controlling includes the steps of:

orienting a magnetic member so as to position remotely the magnetic poles from the region opposed to the photoconductive surface in the second region; and generating a weaker magnetic field in the second region than in the first region.

34. A method of printing as recited in claim 33, wherein said step of controlling includes the step of positioning the magnetic member in the first region a first distance from the photoconductive surface and the magnetic member in the second region a second distance from the latent image with the first distance being less than the second distance.

* * * * *